US005685459A

United States Patent [19]

Wardle

[11] Patent Number: 5,685,459

[45] Date of Patent: Nov. 11, 1997

[54] LIQUID DISPENSING APPARATUS

[75] Inventor: David G. Wardle, Tadworth, England

[73] Assignee: The BOC Group plc, Windlesham, England

[21] Appl. No.: 492,682

[22] Filed: Jun. 20, 1995

[30] Foreign Application Priority Data

Jul. 7, 1994 [GB] United Kingdom ..... 94-13754

[51] Int. Cl.[6] ..... B67D 5/62

[52] U.S. Cl. ..... 222/146.6; 62/50.1; 222/504; 222/518

[58] Field of Search ..... 222/146.6, 504, 222/518; 62/50.1

[56] References Cited

U.S. PATENT DOCUMENTS

| | | | |
|---|---|---|---|
| 4,962,871 | 10/1990 | Reeves | 222/518 X |
| 5,074,443 | 12/1991 | Fujii et al. | 222/504 X |
| 5,356,034 | 10/1994 | Schlumberger | 222/504 X |
| 5,400,601 | 3/1995 | Germain et al. | 62/50.1 |
| 5,405,050 | 4/1995 | Walsh | 222/504 X |

FOREIGN PATENT DOCUMENTS

| | | |
|---|---|---|
| A-591107 | 4/1994 | European Pat. Off. . |
| A59-106799 | 6/1984 | Japan . |
| 2 092 552 | 8/1982 | United Kingdom . |
| 2 251 296 | 7/1992 | United Kingdom . |

*Primary Examiner*—Joseph Kaufman

*Attorney, Agent, or Firm*—R. Hain Swope; Roger M. Rathbun

[57] ABSTRACT

A liquid dispenser for dispensing liquid cryogen comprises a vessel (10) and a valve/actuator arrangement (16, 18) the valve being positioned within the vessel and operable to obturate or uncover an outlet orifice (14). The actuator (18) being positioned wholly or substantially outside the vessel, but being able to generate a magnetic force within the vessel for moving a magnet on the valve so as to move the valve between open and closed positions.

9 Claims, 3 Drawing Sheets

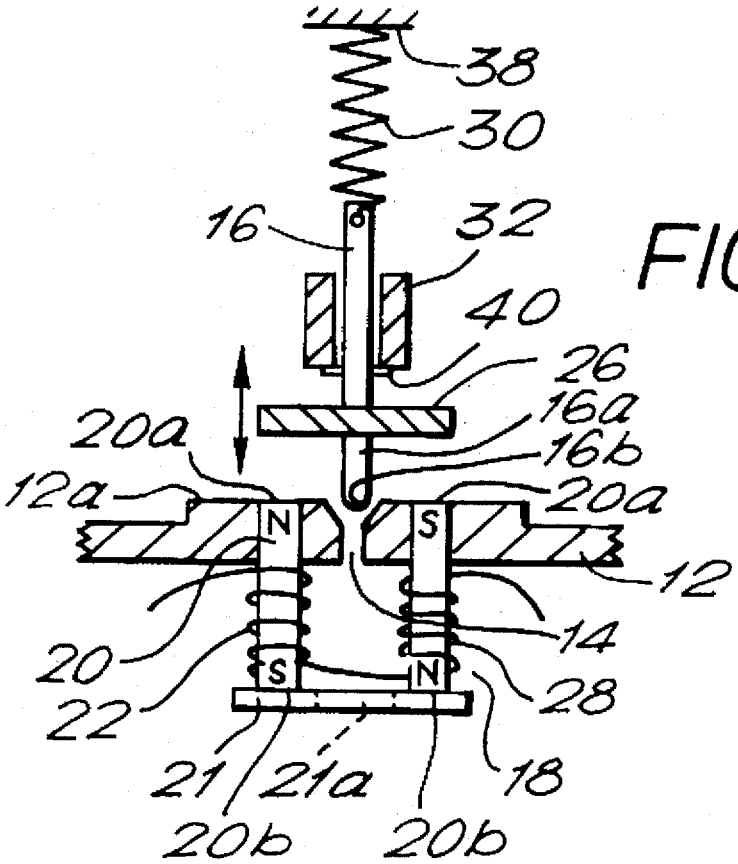
FIG. 3.
FIG. 4.
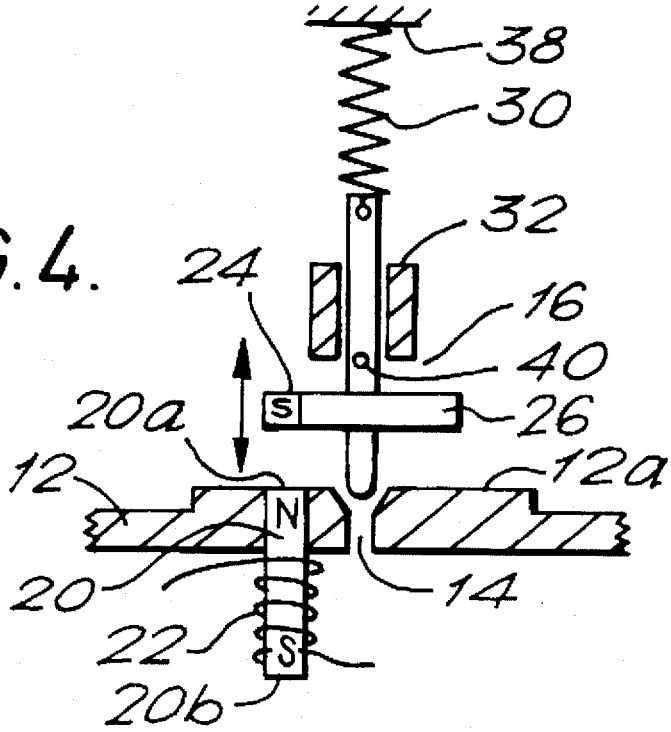

LIQUID DISPENSING APPARATUS

The present invention relates to apparatus for dispensing droplets of liquid and relates particularly, but not exclusively, to apparatus for dispensing droplets of chosen or suitable volume of a cryogenic liquid, for example, liquid nitrogen.

BACKGROUND OF THE INVENTION

Liquid gases are typically used in industry in bulk quantities and can thus be metered by conventional methods. In certain instances, however, a need arises for only a small quantity, for example, up to a few milliliters of liquified gas to be delivered. A typical example of such a need occurs in the bottling of beverage. It is often desirable for the neck of each bottle to contain an atmosphere consisting essentially of a gas, such as nitrogen, that protects the beverage from oxidation yet does not adversely affect the quality of its flavor. Moreover, even if nitrogen is not required for this reason, it is advantageous to alleviate the problem caused by the partial vacuum can be created in its neck of a closed plastic bottle containing a beverage as a result of a reduction in temperature. The partial vacuum can cause a wall of the bottle to be sucked inward. Filling the neckspace with a small volume of nitrogen (or other suitable gas) before fitting a closure thereto will guard against the creation of such a partial vacuum. The gas may also be used to pressurize the walls of a thin walled can thereby increasing its resistance to crushing.

Previous attempts to solve the problem of delivering or dispensing droplets of liquid nitrogen (or other liquified gas) include that described in GB 2092552 in which an insulated tank of liquid nitrogen is provided with a valve on its inside bottom surface and an actuator on an outer upper surface thereof. The actuator is linked to the valve via a long rod such that, in operation, the valve is actuated whenever the rod is moved up and down. This arrangement whilst providing a perfectly adequate method of dispensing droplets does suffer from problems associated with the use of a slender rod connector. The mass of the rod must be as low as possible in order to minimize its inertia and facilitate high speed operation. Unfortunately, there is a point beyond which it is not possible to reduce the diameter (and hence the mass) of the rod without adversely affecting its strength. Additionally, the higher the rod mass the higher the valve wear rate and hence the higher the leakage potential. Consequently, this arrangement does not lend itself to use at relatively high frequencies.

An alternative arrangement is illustrated in GB 2251296 in which an insulated vessel is provided with a valve and actuator arrangement both of which are located wholly within the vessel. The valve comprises a tapered member which is biased downwardly by a spring and which is connected to a permanent magnet disposed in a coil which forms part of the actuator. The tapered member can be driven upwardly or downwardly according to the sense in which a direct current is applied to the coil. This arrangement whilst overcoming the problems associated with an actuator positioned outside the cryogenic vessel does not lend itself to easy maintenance. Typically, the vessel must be drained and the entire valve/actuator assembly dismantled just to service the actuator. An additional disadvantage of such apparatus are the problems typically encountered when routing electric wires through the walls of an insulated container. In accordance with the present invention, there is provided a liquid dispensing apparatus which substantially reduces, and possibly eliminates, the problems associated with the two dispensers described above.

SUMMARY OF THE INVENTION

Accordingly, the present invention provides a dispenser for dispensing drops of cryogenic liquid comprising a vessel for holding cryogenic liquid having an outlet orifice for allowing liquid cryogen to drain from said vessel, a valve associated with said outlet orifice and operable to allow or inhibit the flow of cryogenic liquid from said vessel and an actuator operable to cause said valve to be opened and closed characterized in that said actuator comprises a magnetic device positioned wholly or substantially outside said vessel for generating a magnetic force within the vessel capable of causing said valve to move between open and closed positions.

BRIEF DESCRIPTION OF THE DRAWINGS

FIG. 3 is a detailed view of the dispenser of the present invention taken in the direction of arrow B in FIG. 2;

FIGS. 4 and 5 illustrate alternative embodiments of the dispenser shown in FIG. 1.

DETAILED DESCRIPTION OF THE PREFERRED EMBODIMENTS

The dispenser for dispensing drops of cryogenic liquid provided in accordance with the present invention comprises a vessel for holding cryogenic liquid having an outlet orifice for allowing liquid cryogen to drain therefrom, a valve associated with said outlet orifice and operable to allow or inhibit the flow of cryogenic liquid from said vessel and an actuator operable to cause the valve to be opened and closed. The actuator comprises a magnetic device positioned wholly or substantially outside the vessel for generating a magnetic force within the vessel capable of causing the valve to move between open and closed positions.

The actuator advantageously comprises an electromagnet having a core with a proximal and a distal end and a coil positioned around said core, the proximal end of the core extending into a base portion of the vessel, and the coil being arranged to receive a current for generating the magnetic field within the vessel. The core may terminate flush with or beyond, i.e. interior of, an inner surface of the base portion of the vessel. Alternatively, the core may terminate short of an inner surface of the base and a portion of the base will cover the proximal end of the core thereby protecting the core from the contents of the vessel.

The actuator may consist of a single or multiple core portions, each core portion being linked at its distal end to the other core portions, if present, via a bridging member. The actuator is provided with a coil portion around each core portion. When a single core is utilized, the valve preferably includes a magnet of opposite polarity to the polarity of the magnetic field generated by the magnetic device. In an embodiment of the present invention wherein the actuator has two or more core portions, the coils around the core portions are wound so as to produce a magnetic field of different polarity at each proximal end and the valve includes a magnetic portion which, in operation, forms a bridge between the poles thereby completing a magnetic loop.

Advantageously, the dispenser includes a spring for biasing the valve towards or away from the closed position. Conveniently, the valve comprises a rod having a rounded end for engagement with a tapered portion of the outlet orifice thereby obturating the outlet when the valve is in the closed position. The dispenser may also preferably include guide means for guiding the valve between its opened and its closed positions.

Figure 1:
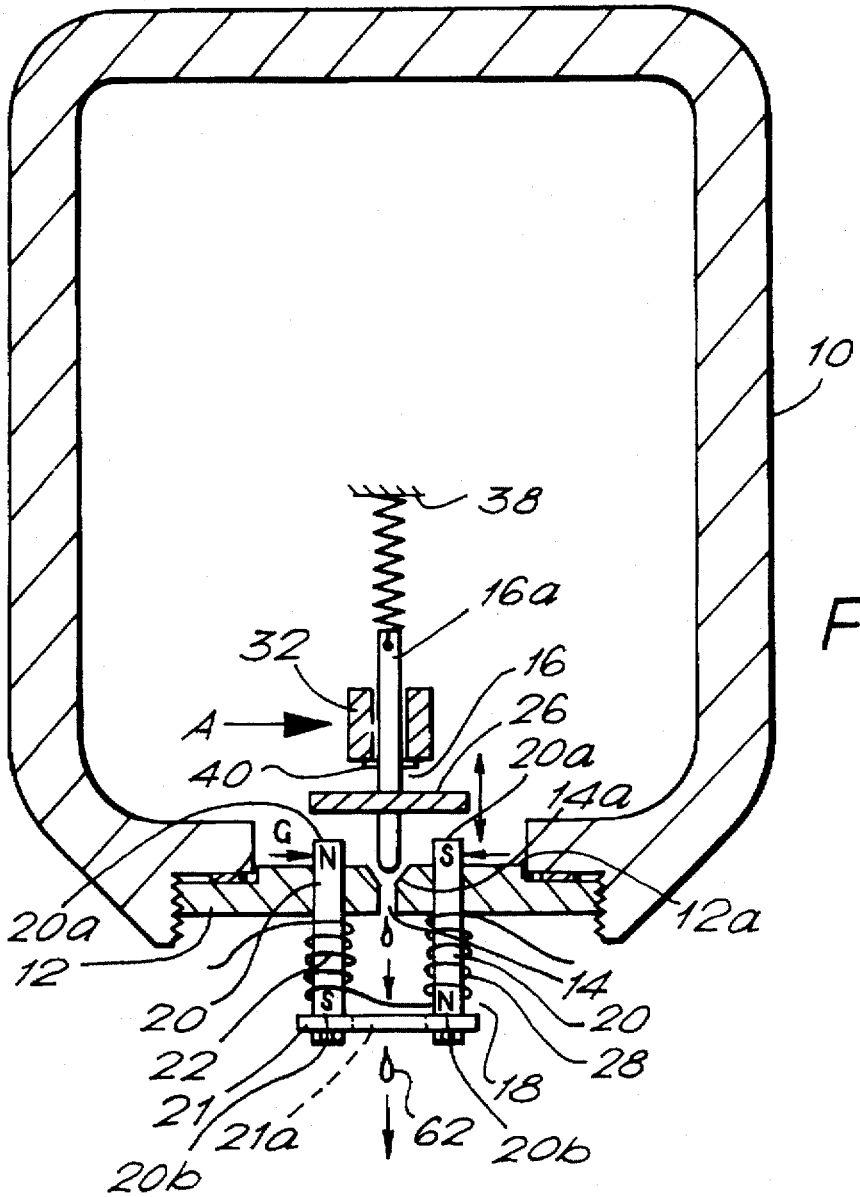
FIG. 1 is a cross sectional view of a cryogenic liquid vessel incorporating a dispenser according to the present invention.

Referring now to the drawings in general and particularly to FIG. 1, a cryogenic vessel 10 includes a base portion 12 having an outlet orifice 14 for allowing liquid cryogen to drain from the vessel 10 as droplets 62. A valve 16 associated with the outlet orifice 14 and operable to allow or inhibit the flow of cryogenic liquid from the vessel 10 is positioned immediately above the base portion 12. The valve includes a rod 16*a* having a low mass, e.g. approximately 1.5 g, made from, for example, aluminum and having a rounded end 16*b* for engagement in a tapered portion 14*a* of orifice 14. An actuator 18 comprising a magnetic device such as, for example, an electromagnetic device, is positioned wholly outside the vessel 10 and acts to generate a magnetic force within the vessel 10 capable of causing valve 16 to move between open and closed positions.

Figure 5:
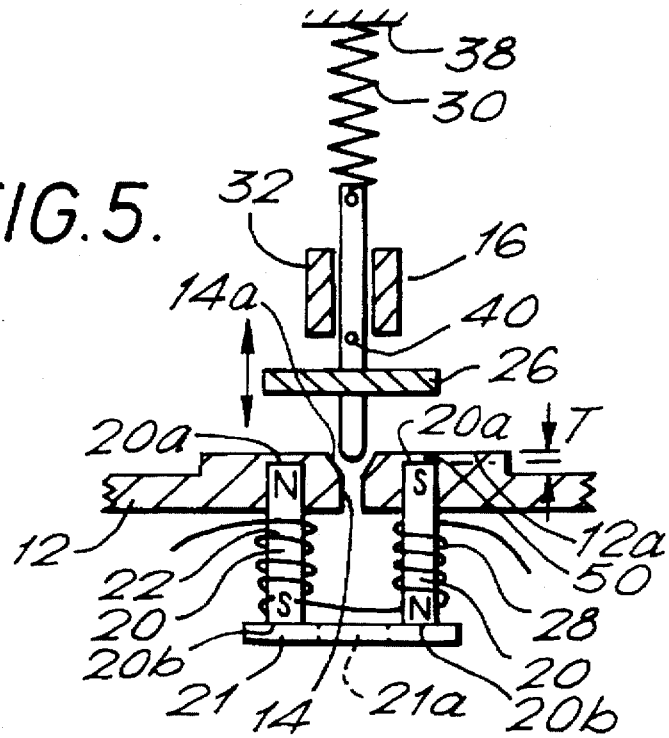

The actuator 18 may comprise any one of a number of well known magnetic field generators but most conveniently comprises a single or multiple coil and core arrangements, preferably the latter. Embodiments having multiple core arrangements are illustrated in FIGS. 1, 3, and 5. An embodiment having a single coil arrangement is shown in FIG. 4.

The double core arrangements as shown in FIGS. 1, 3 and 5, but with specific reference to FIG. 1, comprise two cores 20 each having a proximal end 20*a* positioned sufficiently close to the valve portion so as to enable any magnetic field generated thereat to act upon a magnetic portion 26 of valve 16. The distal ends 20*b* of the cores 20 are connected via a simple magnetic ring 21 having a hole 21*a* through which droplets of liquid cryogen 62 pass. Conveniently, the two coils 22, 28 may be wound in opposite directions so as to produce differing polarities at their proximal ends 20*a*. In such an arrangement, the magnetic portion 26 need have no magnetism of its own and may be made of a suitable material such as steel. The magnetic portion 26 simply functions to bridge the gap G between the proximal core ends 20*a* so as to complete the magnetic circuit whenever the coils are energized.

Figure 2:
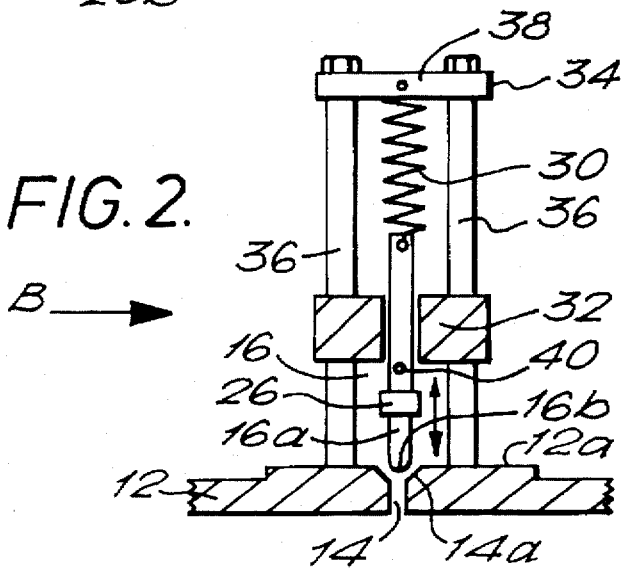
FIG. 2 is a detailed view of the valve construction of the dispenser of the present invention taken in the direction of arrow A in FIG. 1.

Detail of the valve construction of the subject apparatus is shown in FIG. 2. Referring to FIG. 2, a spring 30 and guide arrangement 32 is provided so as to bias the valve towards an open position and guide the valve when in operation. Conveniently, the guide 32 and spring 30 are mounted on a frame 34 comprising a pair of uprights 36 having the guide 32 and an anchor point 38 for the spring 30 mounted thereon. A pin 40 acts to limit valve travel.

The positions of the core proximal ends 20*a* in various embodiments of the apparatus of the present invention are illustrated in FIGS. 1 and 3 to 5. In FIG. 1, the proximal ends 20*a* are arranged to extend into and through base plate 12 such that they terminate just inside the vessel 10, i.e. just beyond the inner surface 12*a* of base plate 12 and, in operation, are surrounded by cryogenic liquid. This arrangement has the advantage of ensuring that the magnet or magnetic portion 26 of the valve remains well clear of the bottom of the vessel 10 thereby ensuring valve operation is not compromised by the presence of any particulate matter which might collect on the bottom of the vessel 10. Alternatively, one could employ the arrangement shown in FIG. 3 in which the proximal ends 20*a* are flush with the inner surface 12*a* of base plate 12. The arrangement shown in FIG. 5 in which the proximal ends 20*a* terminate just short of the inner surface of base plate 12 and are protected by a thin layer 50 of base plate material, may be employed whenever it is desired to protect the cores 20 from the liquid to be contained within the vessel. This arrangement has the additional advantage of avoiding problems associated with sealing the core within the base plate 12 so as to prevent leakage of liquid. In the FIG. 5 arrangement, the base plate 12 may be selected from a range of suitable non-magnetic materials and the thickness T of layer 50 is chosen so as to ensure an adequate magnetic force can be transmitted therethrough. Stainless steel lends itself to use as a base plate 12 in any of the illustrations in FIGS. 1 to 5, since it is generally non-magnetic.

A single coil embodiment of the apparatus of the present invention is illustrated in FIG. 4. In the apparatus shown in FIG.4, a part 24 of magnet portion 26 of the valve 16 is magnetized and is matched with the core 20 and coil 22 such that, in operation, the polarity of the core end 20*a* proximal to the magnet part 24 of magnetic portion 26 is such as to drive the rod 16*a* in a desired direction so as to open or close the valve 16. In the embodiment having a single core 20 arranged beneath the valve 16, it may be most convenient to arrange the polarities such as to cause the valve 16 to be drawn downwardly thereby to obturate the tapered portion 14*a* on orifice 14 whenever the coil is energized. Alternative arrangements will, however, present themselves to one of ordinary skill in the art of electromagnetic actuators.

Operation of the dispenser is achieved by applying a D.C. current to coils 22, 28 so as to generate a magnetic field adjacent the proximal end(s) 20*a* of core(s) 20. The magnetic field acts to attract (or repel in appropriate arrangements) the magnet or magnetic portion 26 of valve 16 thereby drawing the rounded end 16*b* of rod 16*a* towards a closed position in which it obturates the tapered portion 14*a* of outlet orifice 14. As soon as the current is turned off, spring 30 acts to retract the rod 16*a* and allow liquid cryogen to pass through orifice 14. By simply turning the current on and off, it is possible to initiate control over the valve 16 so as to allow or inhibit the flow of cryogen from the vessel 10. The faster the rate of switching the higher the number of drops of cryogen per minute. Operation at over 1000 cycles per minute and possibly 1800 cycles per minute is possible. Clearly, one could use an A.C. current so as to electromagnetically drive the valve between open and closed positions. In such an arrangement one need only vary the frequency of the current in order to control the speed of the valve operation.

Figure 6:
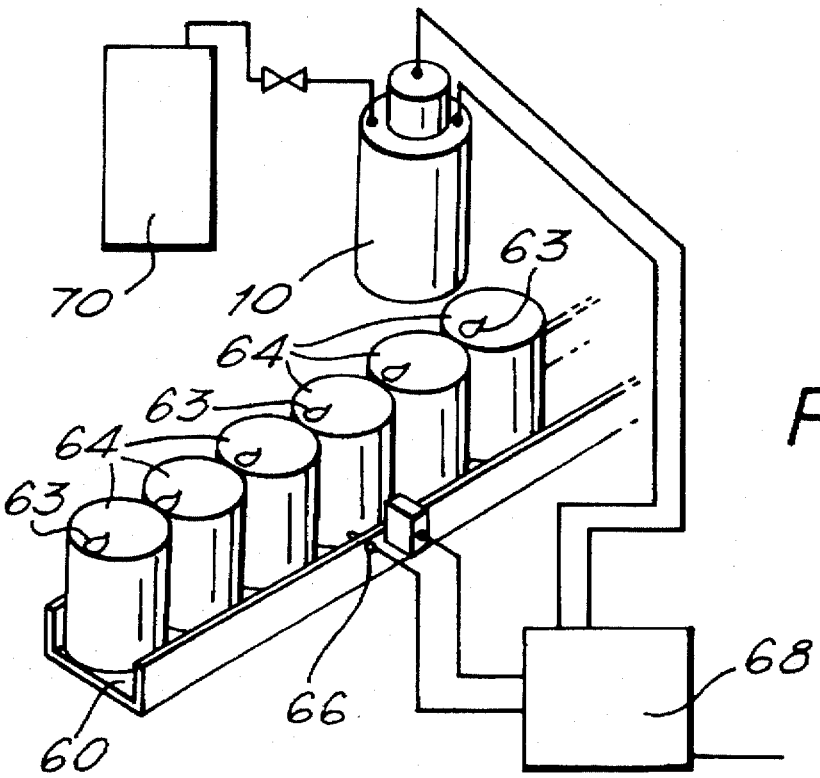
FIG. 6 is a schematic drawing illustrating part of a bottle or canning line fitted with apparatus similar to that shown in FIGS. 1 to 4.

Turning now briefly to FIG. 6, it will be seen that vessel 10 is positioned above a bottle or canning line 60 such that, in operation, droplets 62 of dispensed cryogen, e.g. nitrogen, as shown in FIG. 1, may be dispensed directly into the opening 63 in a bottle or can 64 positioned thereunder. An optical or mechanical sensor 66 acts to detect the presence of a can or bottle and sends a signal to control panel 68 which initiates operation of actuator 18 as and when desired. A bulk source of liquid cryogen 70 is provided for ensuring an adequate liquid level is maintained in vessel 10.

It will be appreciated that the present invention has a number of advantages over the prior art dispensers. Firstly, by providing the actuator mechanism 18 wholly or substantially outside the vessel 10 it is possible to eliminate the requirement to route electrical wires into the interior of the vessel, thereby eliminating the sealing problems associated with such wiring. Additionally, the actuator is not exposed to the sometimes hostile environment inside the vessel. Maintenance is also simplified as the actuator can be serviced and possibly even replaced without first draining the vessel 10 and without disturbing the somewhat delicate valve assembly. By placing the actuator immediately adjacent the valve it is possible to eliminate the long actuator rod assembly as described in GB 2092552 and the problems associated therewith. The relatively low mass and hence inertia of the rod lends itself to high speed operation.

I claim:

1. A dispenser for dispensing drops of cryogenic liquid comprising a vessel for holding cryogenic liquid having an outlet orifice for allowing liquid cryogen to drain from said vessel, a valve positioned within said vessel associated with said outlet orifice and operable to allow or inhibit the flow of cryogenic liquid from said vessel, and an actuator operable to cause said valve to be opened and closed characterized in that said actuator comprises a magnetic device positioned outside said vessel for generating a magnetic force within the vessel capable of causing said valve to move between open and closed positions.

2. A dispenser in accordance with claim 1 wherein said actuator comprises an electromagnet having a core with a proximal and a distal end and a coil positioned around said core, said proximal end of said core extending into a base portion of said vessel, said coil being operably connected to receive a current for generating said magnetic force within said vessel.

3. A dispenser in accordance with claim 2, wherein said core terminates within said base but short of an inner surface thereof and wherein a portion of the base covers the proximal end of said core thereby protecting said core from the contents of the vessel.

4. A dispenser in accordance with claim 2, wherein said actuator comprises two core portions linked at their distal ends via a bridging member.

5. A dispenser in accordance with claim 4, wherein the coils around said core portions are wound so as to produce a magnetic field of different polarity at each proximal end and said valve includes a magnetic portion which forms a bridge between said proximal ends thereby completing a magnetic loop.

6. A dispenser in accordance with claim 1, wherein said valve includes a magnet of opposite polarity to the polarity of the magnetic force generated by the magnetic device.

7. A dispenser in accordance with claim 1 further including a spring for biasing said valve towards or away from said closed position.

8. A dispenser in accordance with claim 1, wherein said valve comprises a rod having a rounded end for engagement with a tapered portion of said outlet orifice thereby obturating said outlet when said valve is in the closed position.

9. A dispenser in accordance with claim 1 including guide means for guiding said valve between its opened and its closed positions.

* * * * *